US006298213B1

(12) United States Patent
Miyamoto et al.

(10) Patent No.: US 6,298,213 B1
(45) **Date of Patent: *Oct. 2, 2001**

(54) IMAGE FORMING APPARATUS WITH IMAGE FIXING MEANS OF LOW HEAT CAPACITY

(75) Inventors: Toshio Miyamoto, Numazu; Masahiro Goto, Mishima; Satoru Izawa, Shizuoka-ken; Masahiko Suzumi, Numazu, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/181,037

(22) Filed: Oct. 28, 1998

(30) Foreign Application Priority Data

Oct. 30, 1997 (JP) ..... 9-316067

(51) Int. Cl.[7] ..... G03G 15/20

(52) U.S. Cl. ..... 399/320; 399/67; 399/69; 399/70; 399/330; 399/331

(58) Field of Search ..... 355/40; 219/216, 219/467–471; 492/46; 432/60; 399/69, 70, 67, 122, 320, 328, 330, 331, 332, 333, 335

(56) References Cited

U.S. PATENT DOCUMENTS

| | | | |
|---|---|---|---|
| 5,153,660 | 10/1992 | Goto | 355/285 |
| 5,253,024 | 10/1993 | Okuda et al. | 355/282 |
| 5,293,202 | 3/1994 | Adachi et al. | 355/282 |
| 5,420,679 | 5/1995 | Goto et al. | 355/285 |
| 5,450,181 | 9/1995 | Tsukida et al. | 355/282 |
| 5,504,567 * | 4/1996 | Satoh et al. | 355/285 |
| 5,572,306 | 11/1996 | Goto et al. | 399/69 |
| 5,722,026 | 2/1998 | Goto et al. | 399/333 |
| 5,771,421 * | 6/1998 | Kim | 399/44 |
| 5,899,599 * | 5/1999 | Kato | 399/69 |
| 5,982,503 | 11/1999 | Miyamoto et al. | 358/400 |

FOREIGN PATENT DOCUMENTS

| | | |
|---|---|---|
| 63-313182 | 12/1988 | (JP) . |
| 02-157878 | 6/1990 | (JP) . |
| 04-044075 | 2/1992 | (JP) . |
| 04-204980 | 7/1992 | (JP) . |

* cited by examiner

*Primary Examiner*—Russell Adams
*Assistant Examiner*—Rodney E Fuller
(74) *Attorney, Agent, or Firm*—Fitzpatrick, Cella, Harper & Scinto

(57) ABSTRACT

An image forming apparatus has an image forming unit for forming an image on a recording material and a fixing unit for fixing the image to the recording material by nipping and conveying the recording material, the fixing unit including a heater which does not generate heat during a standby period in which a printing operation can be started. The heater generates heat for a predetermined period after the start of power supply to the apparatus and then the apparatus is rendered capable of the printing operation.

3 Claims, 12 Drawing Sheets

FIRST EMBODIMENT

IMAGE FORMING APPARATUS WITH IMAGE FIXING MEANS OF LOW HEAT CAPACITY

BACKGROUND OF THE INVENTION

1. Field of the Invention

The present invention relates to an image forming apparatus such as a copying apparatus or a printer, and more particularly to an image forming apparatus in which the heater of the fixing device does not require electric power supply while in a standby state waiting for the input of a print signal.

2. Related Background Art

In the image forming apparatus such as copying apparatus, printer or fascimile, as the thermal fixation device for thermally fixing an unfixed toner image, formed by a suitable image forming process such as electrophotographic process, electrostatic recording process or magnetic recording process corresponding to desired image information and deposited on a recording material (sheet member such as a transfer sheet, a photosensitive paper, an electrostatic recording paper or a printing paper) by a transfer method (indirect method) or a direct method, there is widely employed a device of contact heating type utilizing a heating roller or a heating film.

In particular, the Japanese Patent Application Laid-open Nos. 63-313182, 2-157878, 4-44075 and 4-204980 propose a thermal fixation method utilizing the film heating method in which a film is provided between a heater and a pressure roller for fixing the toner image on the recording material, thereby dispensing with the electric power supply to the heat fixation device in the standby state and minimizing the electric power consumption.

FIG. 14 is a schematic view showing the configuration of the principal portions of such device, in which provided are a heating member (hereinafter called heater) 11 fixed and supported by a stay holder (support member) 12, and an elastic pressure roller 20 pressure contacted with the heater 11 via a heat-resistant thin film (hereinafter called fixing film) 13, forming a nip portion (fixing nip) N of a predetermined nip width. The heater 11 is heated and maintained at a predetermined temperature by electric power supply. The fixing film 13 is a cylindrical or endless belt-shaped member, or a rolled web-shaped member, transported in a direction shown by arrow a, by unrepresented drive means or by the rotating force of the pressure roller 20, in sliding contact with the surface of the heater 11 at the fixing nip portion N.

In a state in which the heater 11 is adjusted to the predetermined temperature and the fixing film 13 is transported in the direction indicated by the arrow, a recording material P constituting a material to be heated and bearing an unfixed toner image t is introduced in the fixing nip portion N between the fixing film 13 and the pressure roller 20, whereby the recording material P is in close contact with the surface of the fixing film 13 and is transported, together with the fixing film 13, in the fixing nip portion N. In the fixing nip portion N, the recording material P and the toner image t are heated by the heater 11 through the fixing film 13 whereby the toner image t on the recording material P is thermally fixed thereto. The portion of the recording material, that has passed the fixing nip portion N, is peeled off from the surface of the fixing film 13 and is transported.

The fixing device of such film heating method can employ, as the heating member, a so-called ceramic heater having a low heat capacity and showing fast temperature rise, and, as the film 13, a thin film also of a low heat capacity, and can realize quick starting in comparison with other heating devices such as of heating roller type, because heating is only required in the nip portion N formed between the heater 11 and the pressure member 20 across the film 13. Therefore, such fixing device is very practical realizing on-demand thermal fixation.

Also the electric power consumption is very low, because the heater need not be powered in the standby state waiting for the entry of the print signal.

However, the pressure roller becomes cold in the standby state because the heater is not powered. Also the temperature is often low immediately after the start of power supply to the image forming apparatus, particularly in a low-temperature atmosphere.

In case the printing operation is started while the pressure roller is cold, the heater is heated to the predetermined temperature capable of fixation immediately after the start of power supply, but the pressure roller shows slower temperature elevation. It is found that, when a first paper sheet is introduced into the nip, the moisture contained in paper evaporates by the heat of the heater and the evaporated moisture condenses and forms dew on the surface of the still cold pressure roller. It is also found that such condensed dew causes slippage of the second and ensuring sheets, thereby inducing unevenness in the image fixation.

SUMMARY OF THE INVENTION

In consideration of the foregoing, an object of the present invention is to provide an image forming apparatus capable of outputting an image without uneven fixation.

Another object of the present invention is to provide an image forming apparatus not condensing moisture to form dew on the surface of the pressure roller.

Still another object of the present invention is to provide an image forming apparatus provided with image forming means for forming an image on a recording material, and fixing means for fixing the image to the recording material by nipping and conveying the recording material, the fixing means including a heater which does not generate heat in a standby period in which printing operation can be started, wherein the heater generates heat during a predetermined period after the start of power supply to the main body of the image forming apparatus and the apparatus is thereafter rendered capable of starting the printing operation.

Still other objects of the present invention, and the features thereof, will become fully apparent from the following detailed description which is to be taken in conjunction with the attached drawings.

DETAILED DESCRIPTION OF THE PREFERRED EMBODIMENTS

Embodiment 1

1. Configuration of Entire Image Forming Apparatus

Figure 1:
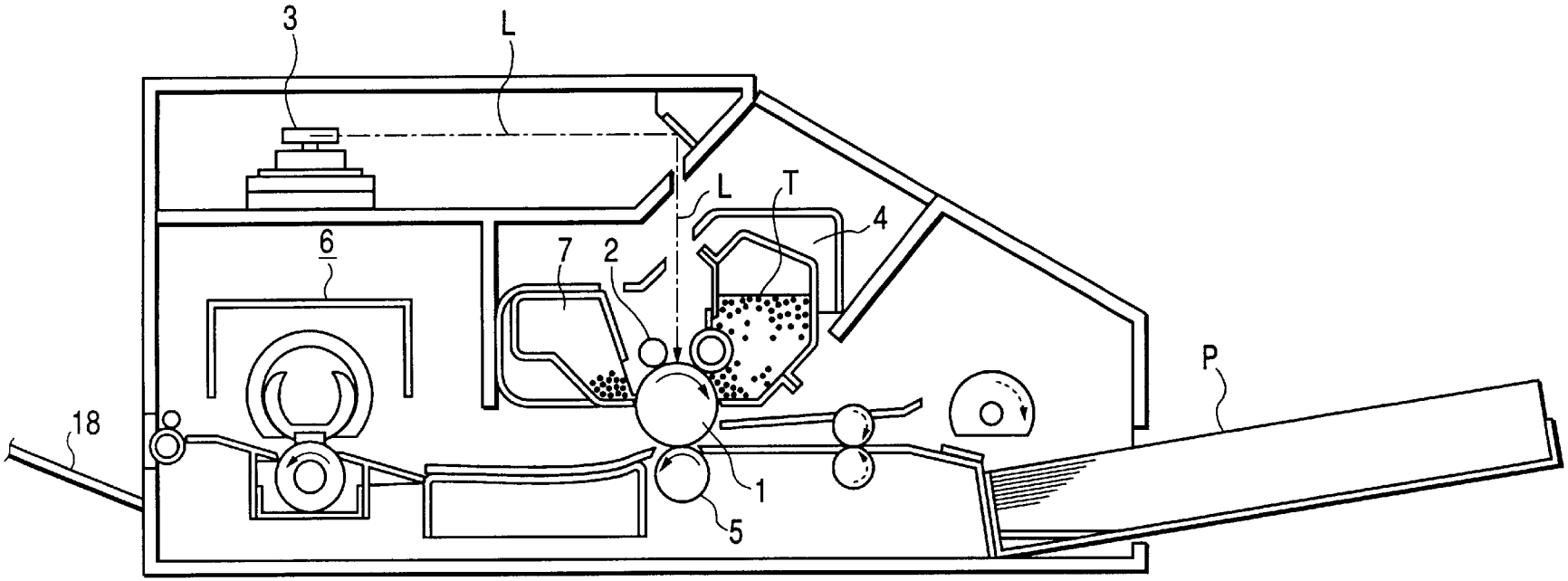
FIG. 1 is a schematic view of an image forming apparatus of the present invention.

In the following there will be shown an embodiment of the present invention. FIG. 1 is a schematic view showing the configuration of an image forming apparatus embodying the present invention.

Referring to FIG. 1, a photosensitive drum 1 is provided with a photosensitive material such as OPC, amorphous Se or amorphous Si formed on a cylindrical substrate of aluminium or nickel. The photosensitive drum 1 is rotated in a direction indicated by an arrow, and the surface thereof is at first uniformly charged by a charging roller 2 constituting a charging device. It is then scan exposed to a laser beam L irradiated from optical scanning means 3 which is on/off controlled according to the image information, whereby an electrostatic latent image is formed. The latent image is developed and rendered visible in a developing device 4. The development is achieved for example by jumping development, two-component development, FEED development etc. and there is often employed the combination of image exposure and reversal development.

The obtained visible image is transferred, by a transfer roller 5 constituting a transfer device, from the photosensitive drum 1 onto a recording material P transported at a predetermined timing. In this operation, the recording material P is conveyed by being sandwiched between the photosensitive drum 1 and the transfer roller 5 with constant pressing force. The recording material P bearing the transferred toner image is conveyed to a fixing device 6 and the toner image is fixed as a permanent image. On the other hand, the residual toner remaining on the photosensitive drum 1 is removed therefrom by a cleaning device 7.

2. Fixing Device 6 (FIG. 2)

a) Entire Configuration of Fixing Device 6

Figure 2:
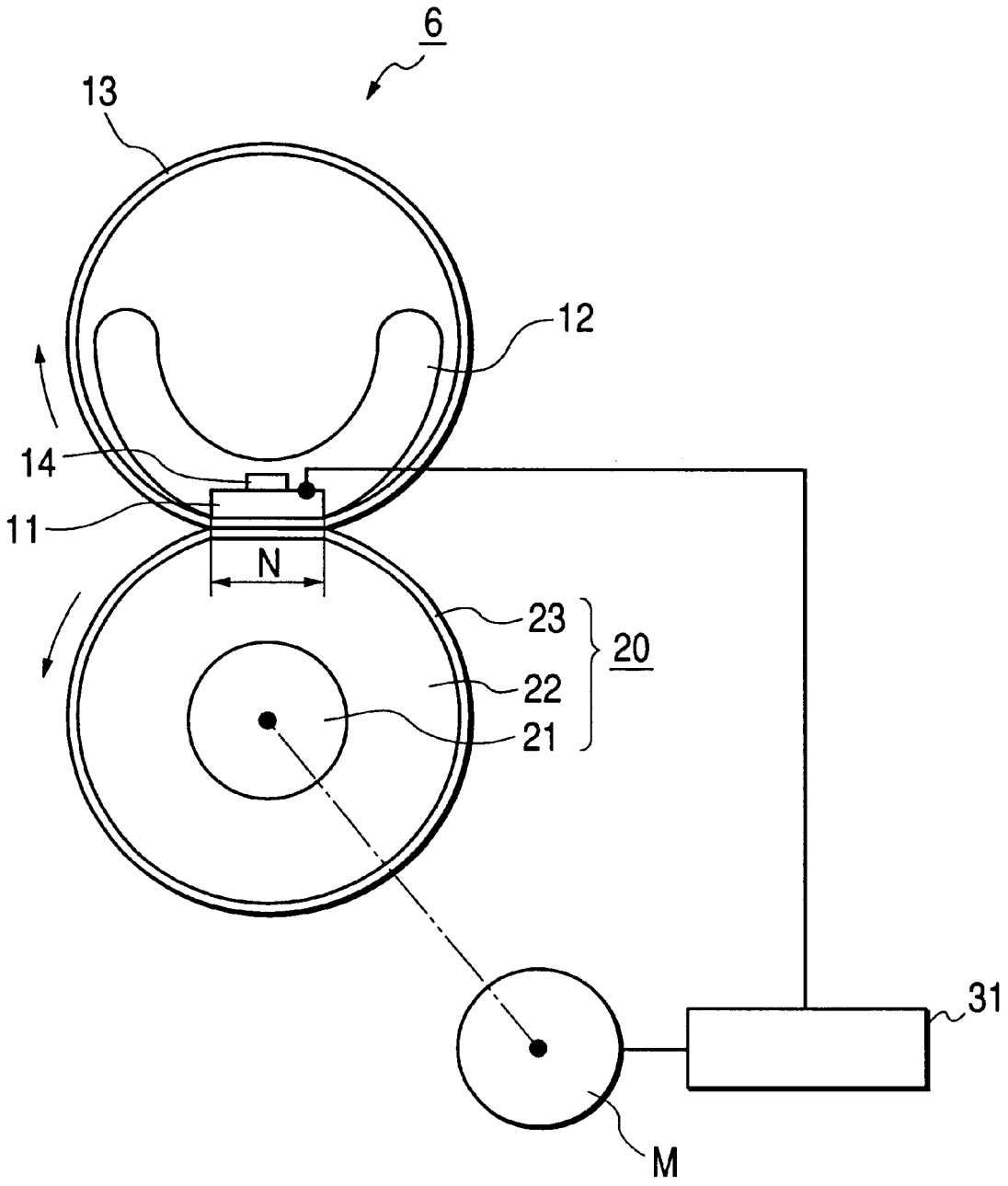
FIG. 2 is a schematic view of a fixing device in the image forming apparatus of the present invention.

FIG. 2 shows the schematic configuration of the fixing device 6 of the present embodiment. Referring to FIG. 2, there are shown a fixing film 13 of a small heat capacity; a heater 11 provided inside the fixing film 13 to heat the nip portion for fusing and fixing the toner image on the recording material; and a heat-insulating stay holder 12 for supporting the heater 11 and preventing heat dissipation in a direction away from the nip. The stay holder 12 is composed, for example, of liquid crystal polymer, phenolic resin, PPS, PEEK etc., and the fixing film 13 is loosely fitted therearound so as to be rotatably in a direction indicated by an arrow. As the fixing film 13 rotates in sliding contact with the heater 11 and the heat-insulating stay holder 12 provided therein, the friction resistance between the fixing film 13 and the heater 11 or the stay holder 12 has to be maintained low. For this purpose, a small amount of lubricant such as heat-resistance grease is provided on the surface of the heater 11 and the heat-insulating stay holder 12, whereby the fixing film 13 is rendered capable of smooth rotation.

A pressure roller 20 constitutes a pressurizing member maintained in pressure contact with the heater 11 via the fixing film 13 and forming a pressure nip portion N. The pressure roller 20 is rotated counterclockwise, as indicated by an arrow, at a predetermined speed. Along with the rotation of the pressure roller 20, the cylindrical fixing film 13 is rotated clockwise, as it is guided by the stay holder 12.

When the recording material P bearing the unfixed image thereon as explained in the foregoing is introduced between the fixing film 13 and the pressure roller 20 in the fixing nip portion N, the recording material P is conveyed in the nip portion N together with the fixing film in close contact therewith, and the unfixed image is fixed to the recording material P by the heat from the heater 11 regulated to the predetermined fixing temperature and by the pressure in the nip portion N.

b) Fixing Film 13

For enabling quick start, the fixing film 13 is composed of heat-resistant thermoplastic resin such as polyimide, polyamidimide, PEEK, PES, PPS, PFA, PTFE or FEP of a thickness not exceeding 100 $\mu$m. Also the film desirably has a thickness of at least 20 $\mu$m for realizing sufficient strength and durability, in order to realize the thermal fixing device of a long service life. Consequently the thickness of the fixing film 13 is optimally within a range from 20 to 100 $\mu$m inclusive. Also for offset prevention and for securing releasability of the recording material, heat-resistant resin of satisfactory releasing ability such as PFA, PTFE, FEP or silicone resin is coated singly or in a mixture on the surface.

c) Heater 11 and Temperature Detecting Means 14

Figures 3A, 3B:
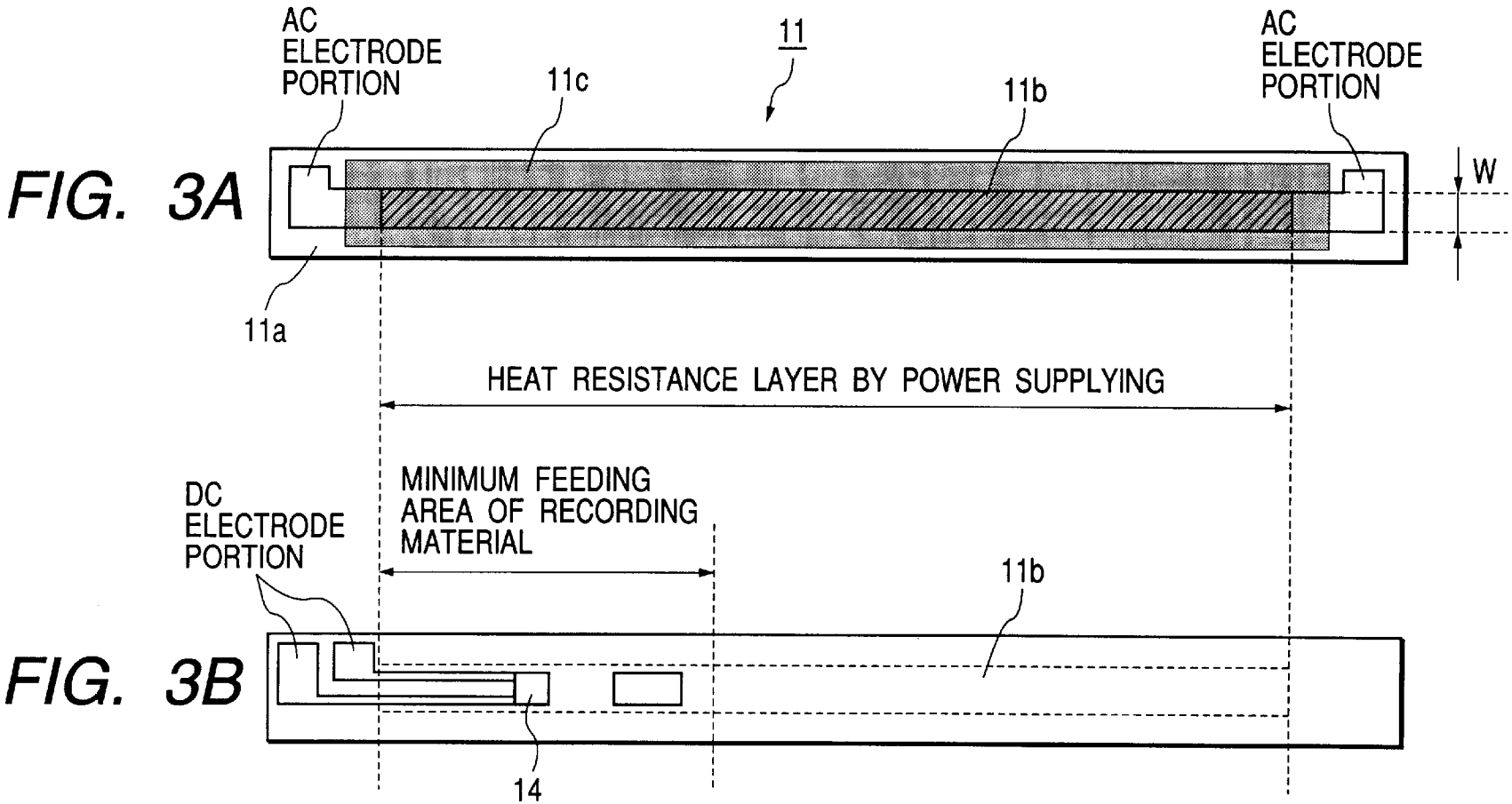
FIGS. 3A and 3B are schematic plan views of a heater.

FIGS. 3A and 3B are schematic plan views respectively of the top side and the bottom side of the heater.

In the present embodiment, the heater 11 is formed by applying, on a highly-insulating ceramic substrate 11*a* (about 0.64 mm thick), a heat-generating resistance layer 11*b* for example of Ag/Pd (silver palladium), $RuO_2$ or $Ta_2N$ in a longitudinally elongated line or stripe shape for example by screen printing, and covering such heat-generating resistance layer with a thin protective glass layer 41*c*. In the present embodiment, the heat-generating resistance layer 11*b* is formed with a width of 5 mm, as shown in FIG. 3A.

In the ceramic heater 11, the heat-generating resistance layer 11*b* generates heat by electric power supply between AC electrodes provided on both ends of the resistance layer 11*b*, whereby the entire heater including the ceramic substrate 11*a* and the protective glass layer 11*c* shows rapid temperature increase. The rise in the temperature of the heater 11 is detected by temperature detecting means 14 provided on the rear face of the heater and is fed back to a power supply control unit (not shown). The power supply control unit controls the power supply to the heat-generating resistance layer 11*b*, in such a manner that the heater temperature detected by the temperature detecting means 14 is maintained at a substantially constant predetermined temperature (fixing temperature). In this manner the heater 11 is heated to and adjusted at the predetermined fixing temperature.

d) Pressure Roller 20

The pressure roller 20 is composed of an elastic layer 22 formed outside a metal core 21 by foaming heat-resistant rubber such as silicone rubber or fluorinated rubber, or silicone rubber, and a releasing layer 23 such as PFA, PTFE, FEP etc. is formed thereon. The pressure roller 20 is sufficiently pressed, at both ends in the longitudinal direction thereof, for forming the nip portion required for thermal fixation, and is rotated counterclockwise, as indicated by an arrow in FIG. 2, by the driving force transmitted from drive means M to a longitudinal end of the metal core 21 through unrepresented transmission means.

3. Temperature Control of Fixing Device

The temperature control of the present invention is featured by the heater 11 of the fixing device 6 being turned on for a predetermined period from the turning-on of the power switch of the image forming apparatus, and a standby state is thereafter assumed.

Figure 4A:
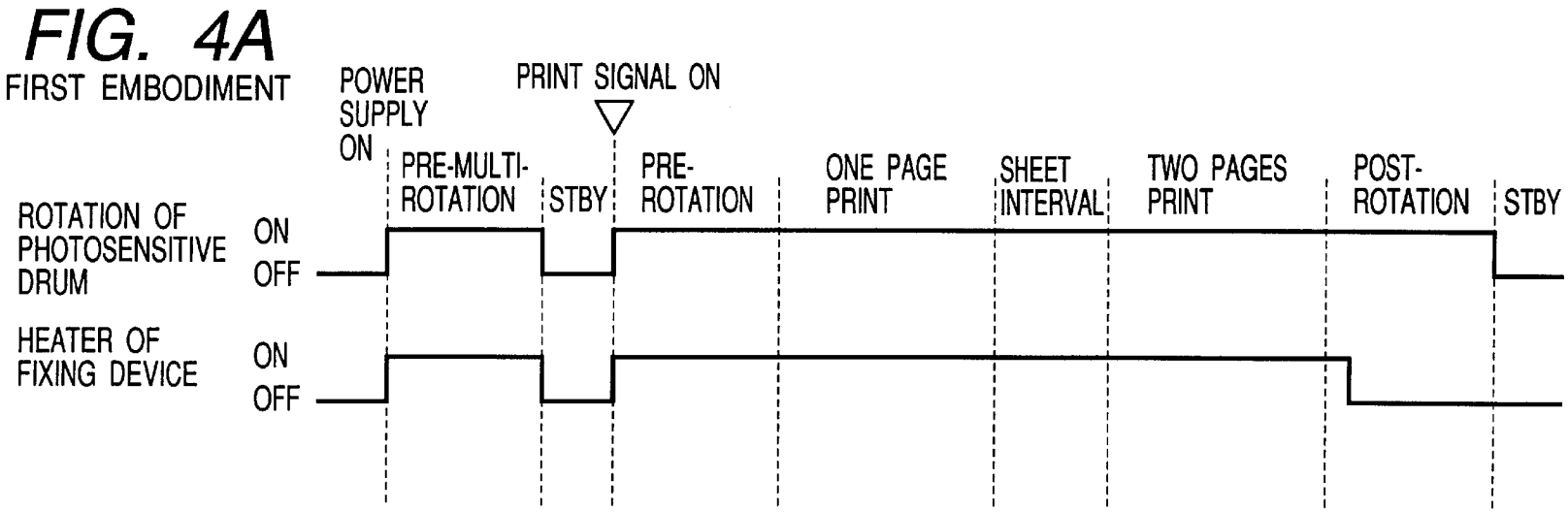
FIGS. 4A and 4B are views showing a fixing sequence of the present invention.
Figure 4B:
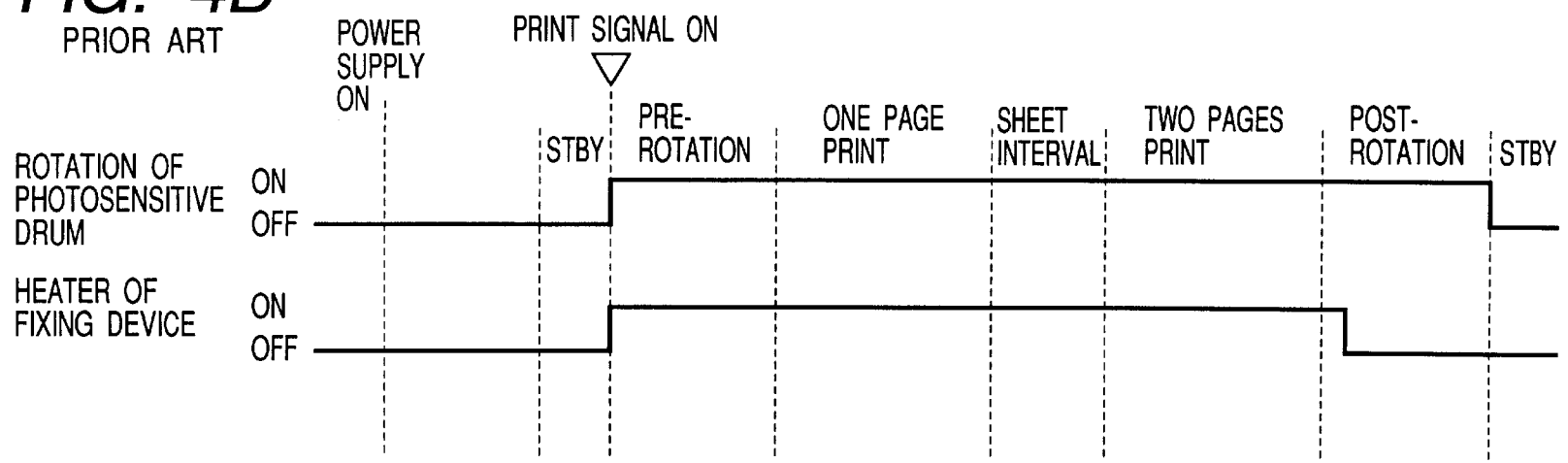
FIG. 4B PRIOR ART

FIG. 4A shows the sequence of temperature control of the fixing device 6, while FIG. 4B shows the sequence of temperature control of a conventional on-demand film-type fixing device.

In the present embodiment, as shown in FIG. 4A, when the power supply of the image forming apparatus is turned on, the fixing film and the pressure roller start to rotate and the heater of the fixing device is also turned on. Thus there are started the heating and temperature control of the heater 11 and the rotation of the pressure roller 20. Subsequently, after the heating and rotation for a predetermined period, the fixing device 6 is turned off (the temperature control of the heater 11 and the drive of the pressure roller 20 being terminated), and thereafter assumed is a standby state in which the fixing device remains off until a print signal is given.

When the power supply is turned on to activate the heater 11, the temperature rises immediately because the heater 11 has a low heat capacity. Consequently, during the power supply of the predetermined period, there is preferably executed temperature control so as to maintain the heater 11 at a constant temperature. The controlled temperature in this state may be same as or different from the fixing temperature. During the temperature control period, the pressure roller is gradually heated to a temperature not causing surface condensation.

In the present embodiment, the controlled temperature before entering the standby state is selected as 180° C., and the power supply period to the heater 11 is selected as 20 seconds.

After the lapse of the power supply period of 20 seconds to the heater 11, the power supply is turned off and the rotation is terminated at the same time. Then there is outputted a ready signal indicating a print ready state, and the standby period begins. The heater 11 is not powered until a print signal is entered thereafter.

When a print signal is entered in the standby period, the power supply to the heater 11 is started, whereby the heater is controlled to the fixing temperature (185° C. in the present embodiment).

Even if the print signal is not entered for a long period after the standby state is assumed, the temperature of pressure roller seldom lowers to room temperature because the interior of the fixing device is already heated.

On the other hand, in the temperature control sequence of the conventional on-demand fixing, the fixing device 6 remains turned off in a period corresponding to the pre-multi rotation in the present invention (rotation of the fixing film and the pressure roller before entering the standby state), and is only turned on in the pre-rotation stage when the printing operation is started in response to the print signal.

The pre-rotation in response to the print signal means a preparatory period of rotating the photosensitive member and effecting charging and charge elimination thereon in order to form a clear image on the photosensitive member.

Figure 5:
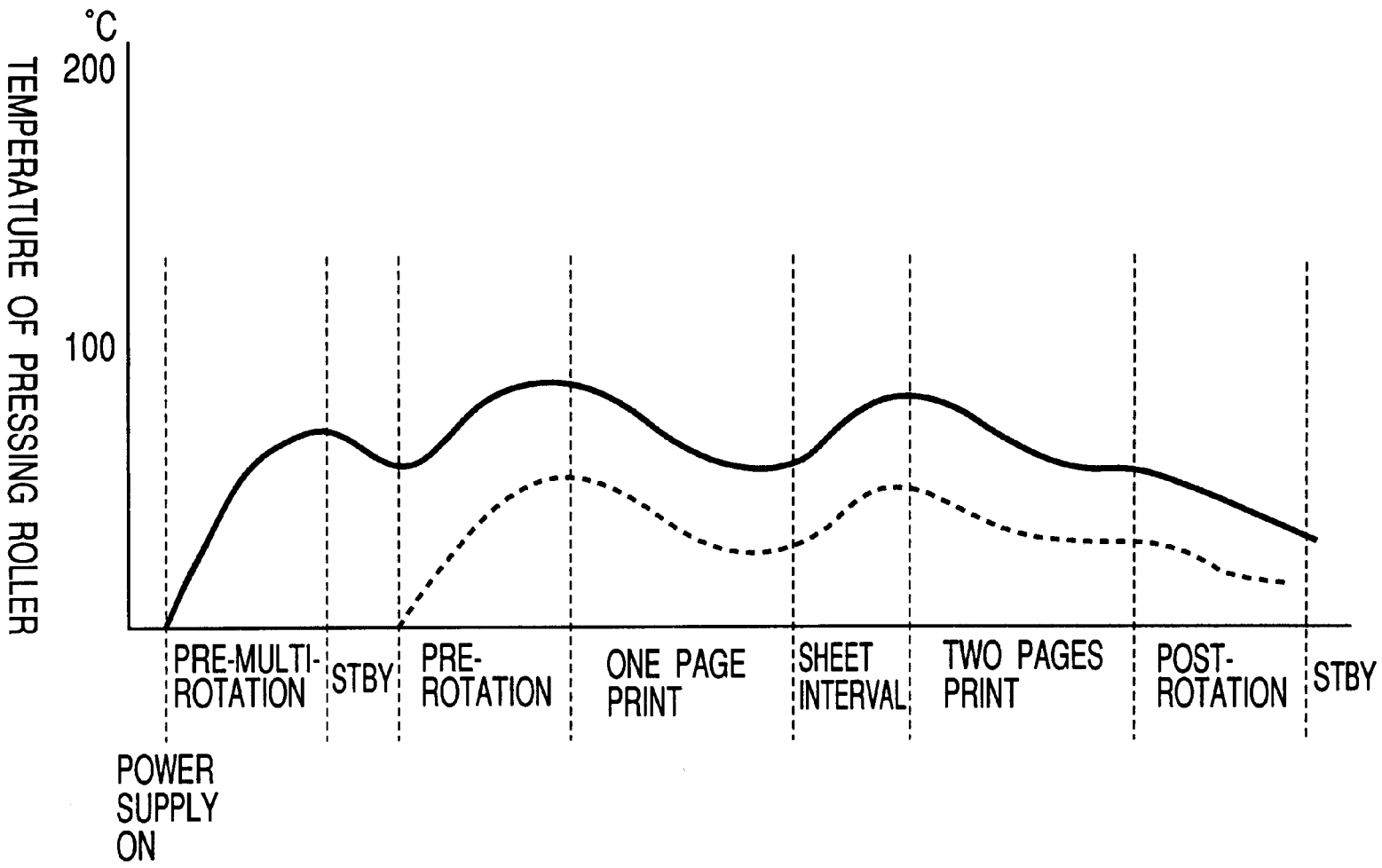
FIG. 5 is a chart showing pressure roller temperature in an embodiment 1 and in a conventional fixing device.

FIG. 5 shows the change in the temperature of the pressure roller in such temperature control sequence, wherein a solid line indicates the present embodiment and a broken line indicates the conventional case.

In the present invention, because the pressure roller 20 is heated during the pre-multi rotation period, the pressure roller reaches about 80° C. at the start of pre-rotation, and is maintained in a range of 90° C. to 70° C. during the printing operation. In contrast, in the conventional sequence, the heating of pressure roller 20 is started, from room temperature, in the pre-rotation state in response to the print signal, so that the temperature of the pressure roller is still low at the start of the printing of the first page and reaches only the range of 60° C. to 40° C. during the printing operation.

The fixing performance was tested in the fixing device of the above-described configuration.

The test was conducted by employing so-called laid paper with coarse surface of a weight of 90 g/m$^2$ as the recording paper and printing at least 10 sheets in continuation in an ordinary environment of 20° C., 50%RH.

Thereafter each printed recording paper was subjected to a rubbing test, by placing a predetermined weight (200 g) on a sheet of paper placed on the image bearing face of the recording paper, rubbing the image bearing face with the placed paper under the above-mentioned weight and the percentage of loss of the image density measured before and after the rubbing was determined. The result was evaluated as satisfactory in case the percentage of loss was in a range from 0% to less than 10%, fair in case the percentage was in a range from 10% to less than 20% and poor in case the percentage was 20% or higher. The measurement was conducted in 9 points on each recording paper and the worst result was employed.

Table 1 shows the obtained results.

TABLE 1

| | first sheet | second sheet | fifth sheet | tenth sheet |
|---|---|---|---|---|
| Present invention | satisfactory | satisfactory | satisfactory | satisfactory |
| Conventional | poor | poor | fair | satisfactory |

The fixing performance in the device of the present embodiment was satisfactory in all of the first to tenth sheets, and the fixing performance was also satisfactory for the ensuing sheets because the temperature of the pressure roller 20 was elevated.

On the other hand, in the conventional configuration, the fixing performance was poor in the first and second sheet because the temperature of the pressure roller 20 was still low, and was still fair up to ninth sheet because the pressure roller 20 was still being heated. More specifically, the image showed peeling off of characters or smearing of fingers in case of a halftone image.

As will be apparent from these results, the pressure roller has to be warmed to a certain extent at the printing of the first sheet in a low-temperature environment, and it is particularly important to maintain the pressure roller at a high temperature for certain papers such as laid paper.

As explained in the foregoing, the present embodiment elevates the temperature of the pressure roller by activating the heater for the predetermined period after the power supply is turned on, thereby preventing dew on the pressure roller at the fixation of the first sheet after the power supply is turned on and avoiding slippage in the second and ensuing sheets. Also there can be achieved satisfactory thermal fixation of the image, thus ensuring satisfactory image formation even on the recording paper with coarse surface or the thick recording paper.

Even if the pressure roller is cooled to the room temperature because of absence of the printing operation for a prolonged period, the complete cooling to the room temperature generally takes 20 to 30 minutes. The present embodiment can therefore be effective in improving the fixing performance, because the printing operation can be expected in every 10 minutes in average.

Also there may be adopted such control as to automatically turn off the power supply of the image forming apparatus after the lapse of 20 to 30 minutes (before cooling to the room temperature). In such case, the user turns on the power supply again at use, so that the image formation can always be executed in a state where the pressure roller 20 is warmed up.

Embodiment 2

Figure 6:
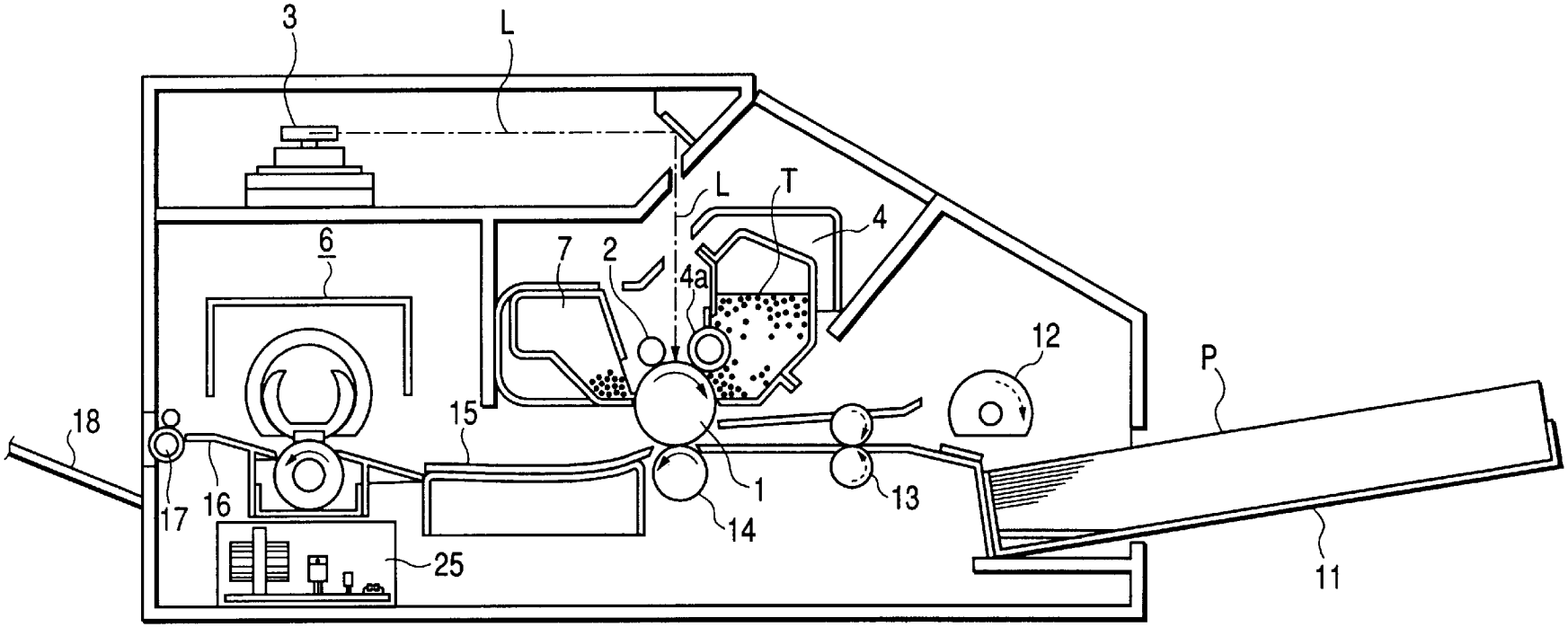
FIG. 6 is a schematic view of an image forming apparatus constituting an embodiment 2.

FIG. 6 is a schematic view of an image forming apparatus constituting a second embodiment of the present invention. The present embodiment is featured in that components of the image forming apparatus, generating heat in operation, are positioned in the vicinity of the on-demand fixing device 6. As other components are similar to those in the first embodiment shown in FIGS. 1 and 2, the same components are represented by same numbers and will not be explained further.

A power supply unit 25 is a component which generates heat at the functioning state, and serves to supply the various devices constituting the image forming apparatus with electric power for example by converting the external electric supply (for example AC 100 V) into a predetermined voltage. The ambient temperature of the power supply unit 25 is elevated to about 50° C. during the operation. Therefore, the power supply unit 25 can be positioned under the fixing device 6 for achieving an effect of warming the vicinity of the fixing device 6 by the heat from the power supply unit 25.

Figure 7:
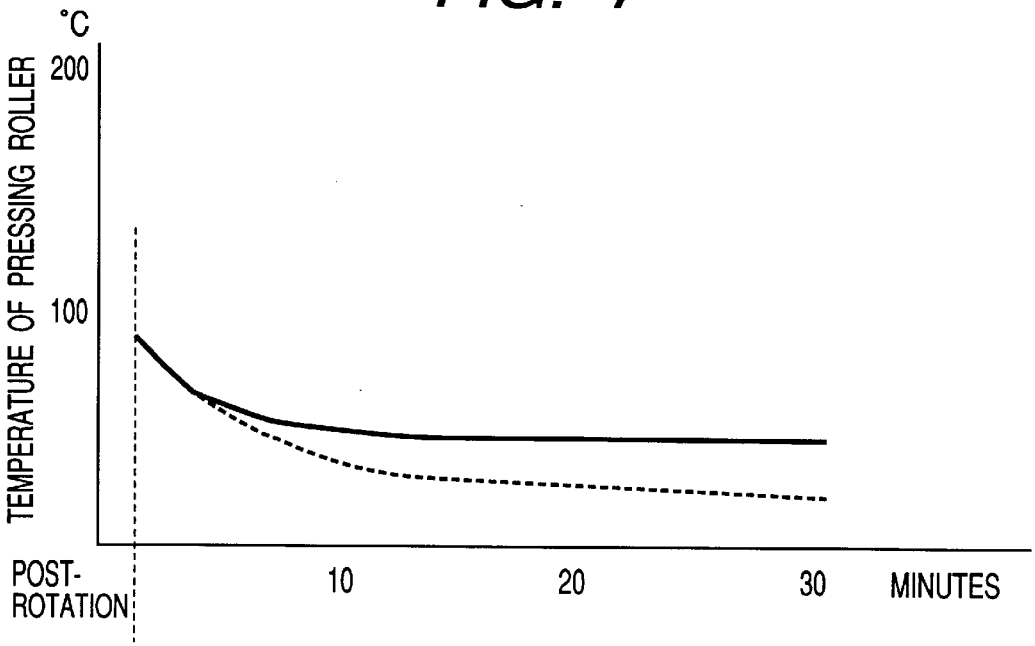
FIG. 7 is a chart showing pressure roller temperature in the embodiment 2 and in a conventional fixing device.

FIG. 7 shows the result of measurement of the temperature decrease of the pressure roller 20 after the post-rotation stage, in which a solid line indicates the case of the present embodiment in which the power supply unit 25 is positioned under the fixing device 6, while a broken line indicates a case in which the power supply unit 25 is so positioned that the heat therefrom is not transmitted to the fixing device 6.

The chart in FIG. 7 indicates that, in the present embodiment, the rate of temperature decrease becomes slower under 70° C. and the temperature of the pressure roller 20 scarcely drops therefrom, since the ambience of the fixing device is heated to about 50° C. On the other hand, in case the heat of the power supply unit is not transmitted to the fixing device, the ambient temperature of the fixing device is close to the room temperature, so that the rate of temperature decrease of the pressure roller becomes slower only under 40° C. and the pressure roller is cooled to about 30° C., as indicated by the broken line.

It is thus possible to prevent the temperature decrease of the pressure roller 20 and to improve the fixing performance, by positioning the power supply unit 25 under the fixing device 6. The fixing performance is related with the temperature of the pressure roller 20 as explained in the embodiment 1.

It is possible to singly execute the present embodiment or the first embodiment, but it is more effective to execute both in combination. In particular, the start of temperature control immediately after the start of power supply in the image forming apparatus is effective, since it increases the power consumption therein and induces heat generation of the power supply unit 25 thereby warming the vicinity of the fixing device in the early stage.

In the foregoing description, the power supply unit is positioned under the fixing device, but such configuration is not restrictive and the power supply unit may be provided in any position that can transmit heat. As the heat transmission from the power supply unit 25 to the fixing device is the key factor, it is effective to form an air path from the power supply unit 25 to the fixing device 6 thereby assisting heat transmission.

Embodiment 3

The present embodiment is an image forming apparatus according to a third invention, and is featured by control means monitoring the electric power consumption of the fixing device in the apparatus and determining the throughput according to the recording material P to be used. Other configurations are substantially the same as those of the first embodiment shown in FIGS. 1 and 2, and will not, therefore, be explained further.

In the on-demand fixing device of the film type, if narrow recording papers are fixed in succession at the maximum throughput, the temperature rises in a transversal part of the fixing device where the papers do not pass, and eventually exceeds the heat-resistant temperature of the fixing device, thereby causing the damage thereto.

In the present embodiment, therefore, the throughput is determined according to the size of the recording paper, and, in case of a narrow recording paper, the throughput is reduced by increasing the interval of the recording papers. In this manner the rotation amount of the pressure roller 20 is increased in the interval of the recording papers, namely in a state where the recording paper is absent in the nip portion N of the fixing device 6, thereby reducing the temperature difference between the part passed by the recording papers and the part not passed by them.

Figure 8:
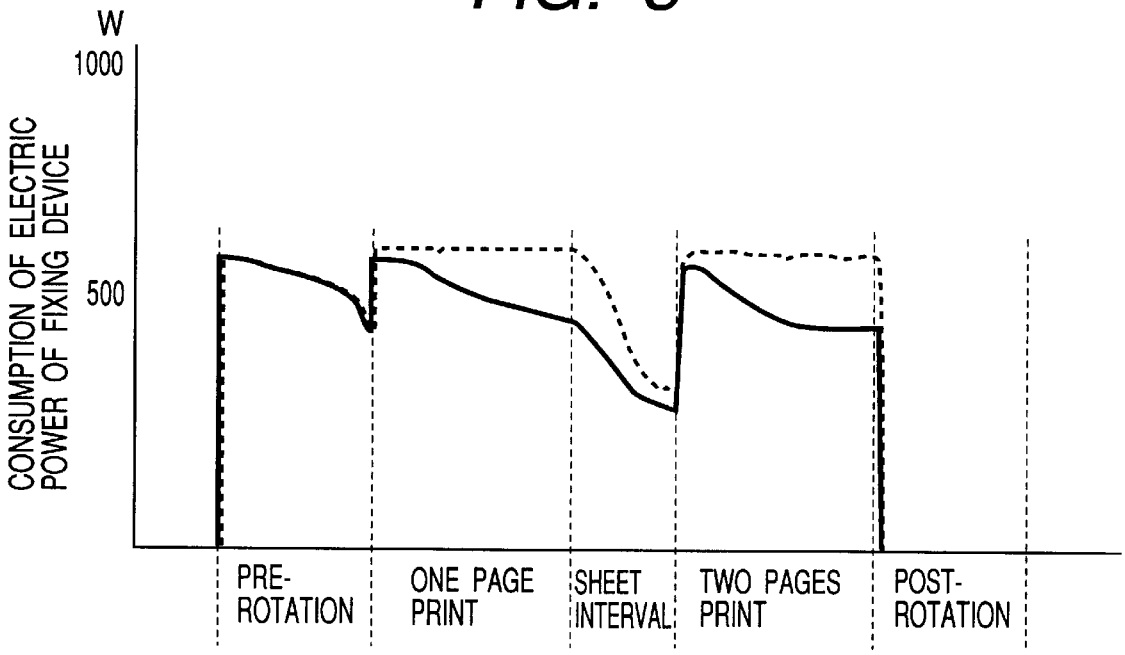
FIG. 8 is a chart showing electric power consumption in an embodiment 3 and in a conventional fixing device.

FIG. 8 is a chart showing the electric power consumption in the printing operation of the device of the present embodiment, wherein a solid line indicates the case of passing the recording papers of a non-standard format (having a width of 150 mm, narrower than the standard paper), while a broken line indicates the case of passing the recording papers of ordinary A4 format. It will be understood that the electric power consumption is lower for the narrower non-standard format papers, because the heat absorbed by the papers is less. It is therefore possible to estimate the width or size (area) of the recording paper by monitoring the power consumption of the fixing device 6.

Figure 9:
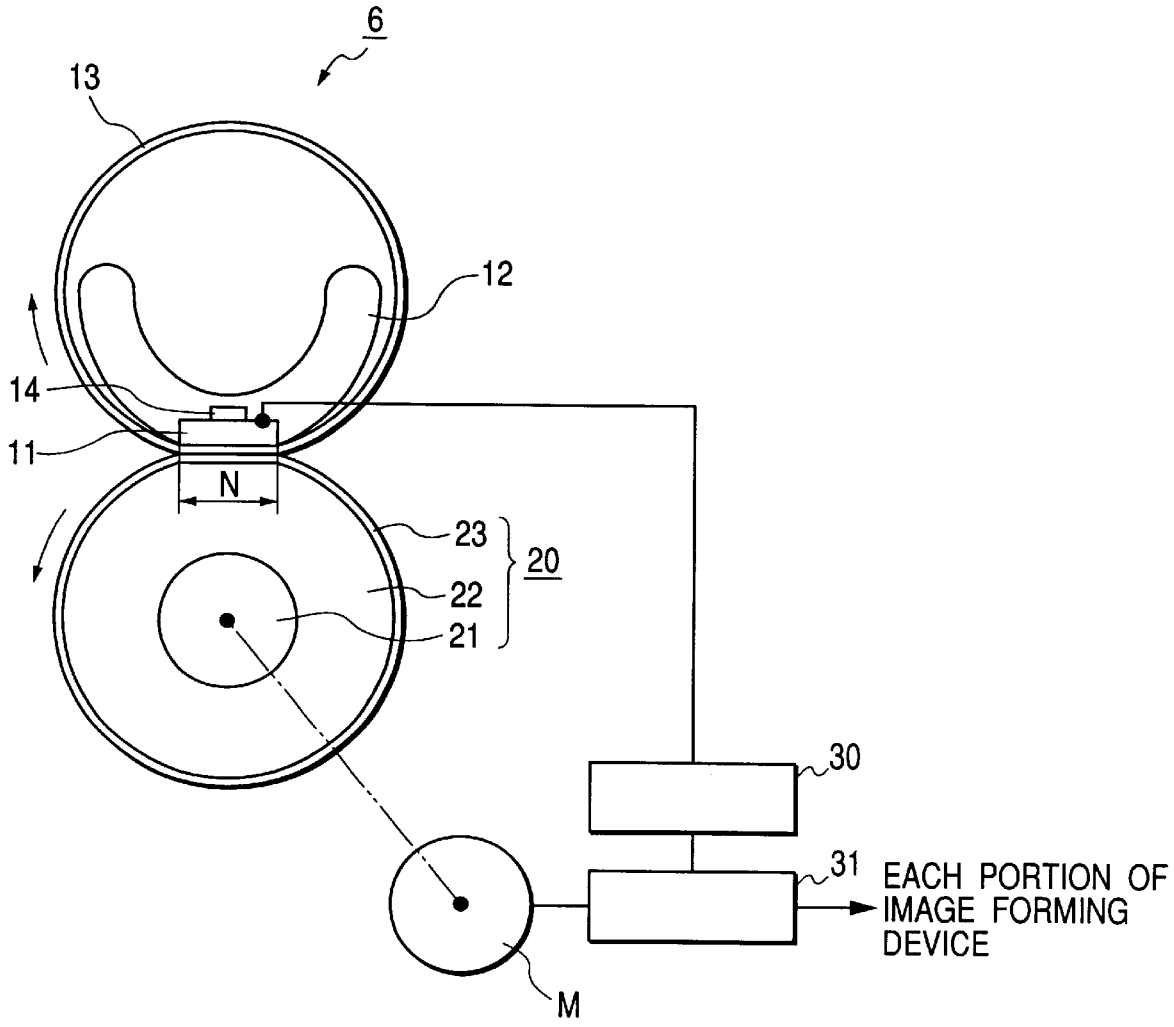
FIG. 9 is a schematic view of a fixing device constituting an embodiment 4.

Thus, as shown in FIG. 9, the power consumption of the fixing device 6 is measured by measurement means 30, of which output signal is transmitted to a controller 31 for determining the print throughput.

As shown in FIG. 8, the device of the present embodiment consumes a power of about 600 W during the printing operation in case of the A4-sized papers. However, in case of narrower non-standard format papers, the power consumption remains same until the recording paper enters the fixing device but is reduced to about 400 W after the entry of such paper because the heat is consumed less in comparison with the A4-sized papers.

The apparatus of the present embodiment is capable of printing 12 A4-sized sheets per minute.

In the present apparatus, in response to the entry of the print start signal, the printing operation is started with a throughput of 12 sheet/minute, and the measurement means 30 detects the power consumption of the fixing device 6 for a period of 1 or 2 sheets. Based on thus detected information, the controller 31 judges that the recording papers are of A4 size and maintains the throughput at 12 sheet/minute if the power consumption is about 600 W, but, if the power consumption is lowered to about 400 W, the recording papers are of a narrower width and the throughput is lowered to 9 sheet/minute.

Conventionally the throughput is determined according to the paper size designated by the user, but the present invention enables such determination in automatic manner.

Embodiment 4

FIG. 9 is a schematic view showing the configuration of the present embodiment.

The present embodiment is a second embodiment of the third invention of the present application. In the apparatus of the present embodiment, components equivalent to those in the apparatus shown in FIG. 2 will be represented by corresponding numbers and will not be explained further.

The present embodiment is designed to prevent defective fixing as a result of deficient electric power, in case of printing thick recording materials P (hereinafter simply represented as thick papers).

Figure 10:
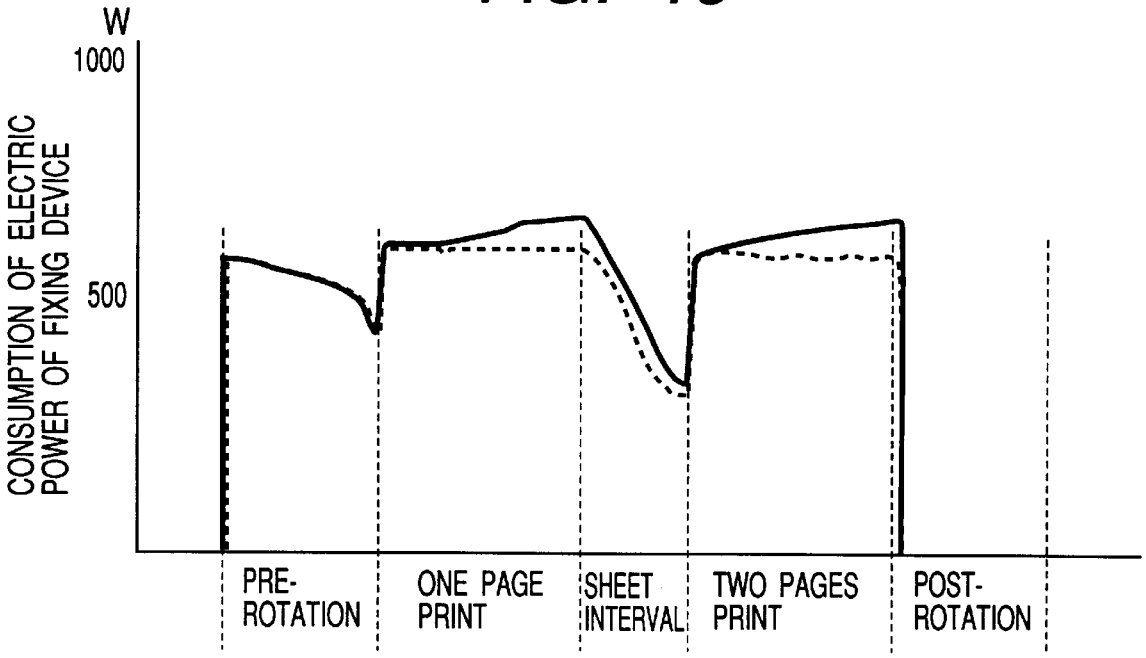
FIG. 10 is a chart showing electric power consumption in the embodiment 4 and in a conventional fixing device.

FIG. 10 is a chart showing the electric power consumption in the printing operation of the fixing device of the present embodiment, wherein a solid line indicates a case of printing on A4-sized thick papers of a weight of 155 g/m$^2$, while a broken line indicates a case of printing on A4-sized ordinary papers of a weight of 64 g/m$^2$. Thick papers require a larger electric power in order to maintain a constant temperature in the fixing device, since a larger amount of heat is taken away by the papers. However, as the heater 11 cannot be operated in excess of the rated power, the image fixation may become defective because of the deficient power supply, depending on the thickness of the recording papers. A heater of a larger rated power may be provided for preventing such phenomenon, but such method is uneconomical because such larger rated power is unnecessary for the recording papers of ordinary thickness.

In the present embodiment, therefore, the electric power consumption of the fixing device 6 in the printing operation is measured by measurement means (electric power meter) 30 provided on the unrepresented power supply, and the signal indicating the power consumption is transmitted to a controller 31 for determining the throughput. More specifically, if the measured power consumption increases as indicated by the solid line in FIG. 8, the recording papers are judged as thick papers, and, because the heat amount for image fixation may become deficient, the throughput is reduced from the maximum value of 12 sheet/minute to 10 sheet/minute by increasing the interval between the papers.

It is thus rendered possible to elevate the temperature of the pressure roller 20 in such interval between the papers, namely to accumulate heat in the pressure roller 20, thereby achieving satisfactory image fixation. The temperature of the pressure roller 20 significantly affects the fixing performance as explained in the first embodiment.

The change in the throughput in case of thick papers can not only secure the fixing performance but also prevent the damage in the fixing device, caused by the temperature elevation in the part where the papers do not pass, in case of non-standard format paper.

As explained in the third embodiment, if the narrow papers are printed in succession with the maximum throughput, the fixing device 6 shows significant temperature rise in the part where the papers do not pass, thus eventually exceeding the maximum heat-resistant temperature.

The third embodiment showed the result with the papers of a weight of 64 g/m$^2$, but the difference in temperature between the paper passing part and the non-passing part becomes larger in case of thick papers (for example 155 g/m$^2$), because a larger amount of heat is taken away in the paper passing part.

Consequently sensors are provided for detecting the paper size (for example B5 size, envelope COM10 size etc.) and for judging whether the thick recording papers are used by monitoring the power consumption in the printing operation, and the throughput is determined according to thus measured paper size and thickness. In this manner it is possible to prevent the temperature elevation in the non-passing part of the papers even when small-sized thick papers are employed.

In the apparatus of the present embodiment, comparison was made, in the narrower non-standard size recording papers of a width of 150 mm and a length of 297 mm, between paper weights of 64 g/m$^2$ and 155 g/m$^2$. The temperature of the part where the papers do not pass could be maintained below the maximum tolerable temperature by lowering the throughput to 9 sheet/minute in case of 64 g/m$^2$ as in the third embodiment and 7 sheet/minute in case of 155 g/m$^2$. The fixing device 6 is thus no longer damaged by determining the throughput as explained in the foregoing in the controller 31, based on the size of the recording papers and the electric power consumption.

The recent spreading of the laser beam printers has increased the variety of the recording paper in the kind, size and thickness, but the present embodiments allow to adequately handle such various recording papers.

Embodiment 5

In contrast to the fourth embodiment, the present embodiment detects the special recording papers that take away a larger amount of heat, such as thick papers, from the temperature decrease of the heater 11 instead of the electric power consumed in the fixing device 6.

Other parts are similar to those in the first embodiment shown in FIGS. 1 and 2, and will not be therefore be explained further.

Figure 11:
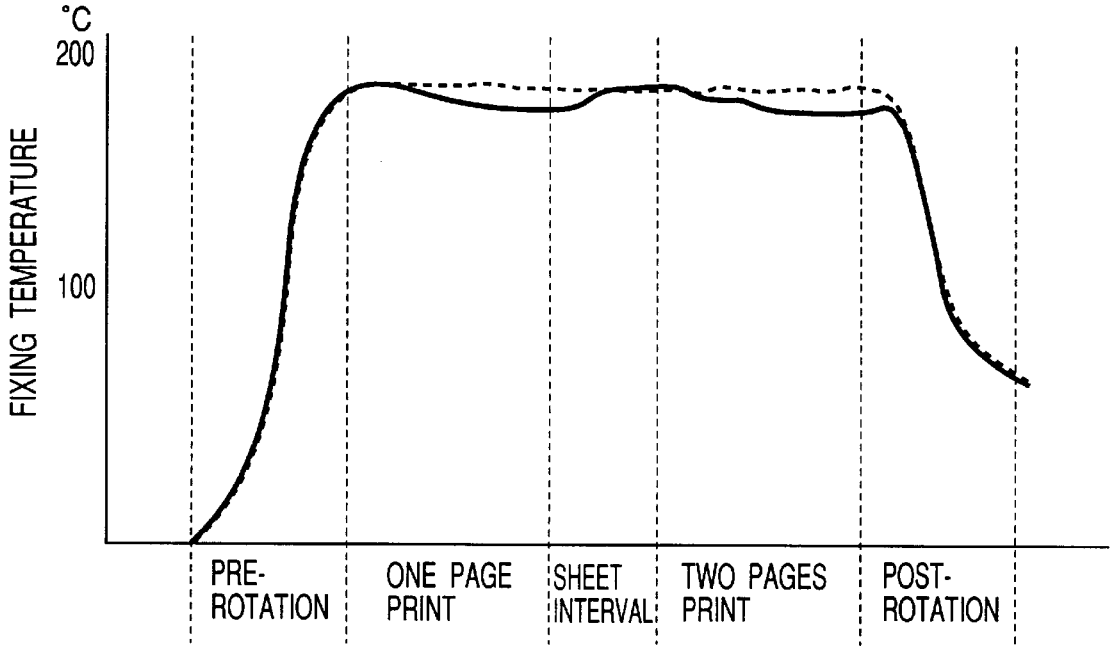
FIG. 11 is a chart showing electric power consumption in an embodiment 5 and in a conventional fixing device.

FIG. 11 is a chart showing the temperature of the fixing device (temperature detected by a thermistor 14 provided on the rear face of the heater) during a printing operation in the apparatus of the present embodiment, wherein a solid line indicates a case of printing on thick papers (155 g/m$^2$) while a broken line indicates a case of printing on ordinary papers (64 g/m$^2$).

FIG. 11 indicates that, in case of thick papers, the temperature gradually decreases because of deficient heat supply during the printing operation. Such phenomenon can be prevented by employing the heater 11 of a larger rated power as explained in the foregoing, but the use of such heater is uneconomical in the use under ordinary condition.

In the apparatus of the present embodiment, in response to the entry of the print start signal, the printing operation is started with a throughput of 12 sheet/minute, and the thermistor 14 detects the temperature of the fixing device for a period of 1 or 2 sheets. Based on thus detected information, the controller 31 varies the throughput. More specifically, if the fixing device 6 is maintained at the controlled temperature, the recording paper is judged as the ordinary paper (64 g/m$^2$) and the throughput is maintained at 12 sheet/minute. If the temperature of the fixing device 6 decreases, the recording paper is judged as the thick paper (special paper) and the throughput is reduced to 10 sheet/minute. In this manner the defective fixation can be prevented even for special paper such as thick paper.

Embodiment 6

In contrast to the fourth embodiment, the present embodiment turns off the heater 11 at the interval between the papers and detects the special paper from the amount of temperature decrease in such interval. Other parts are substantially same as those in the foregoing fourth embodiment.

Figure 12:
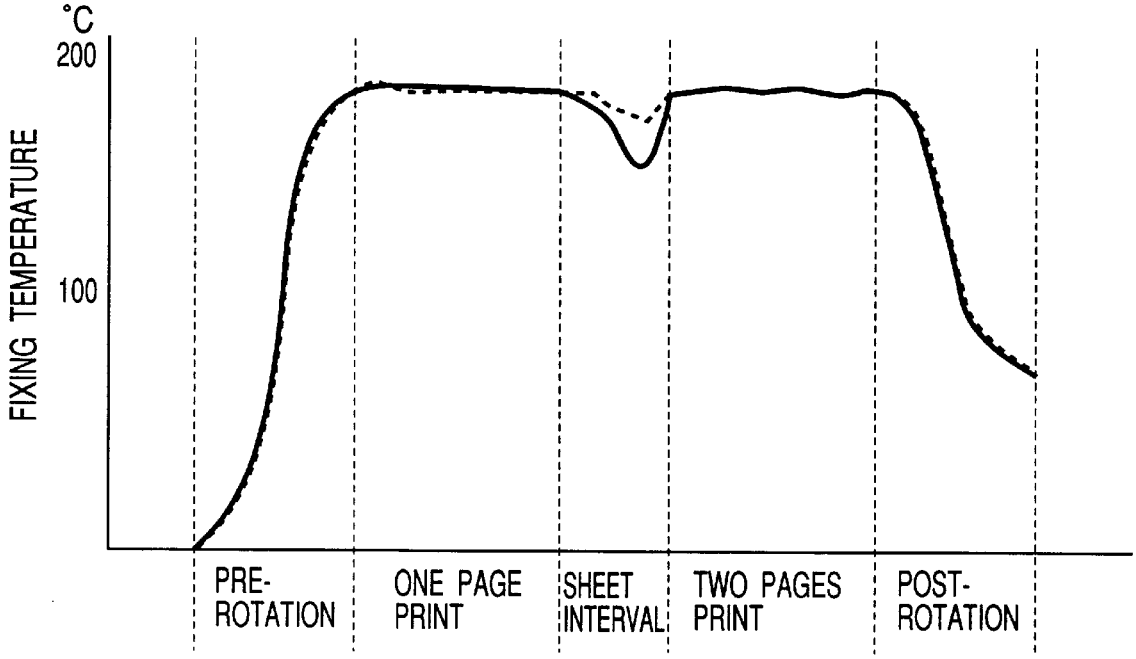
FIG. 12 is a chart showing electric power consumption in an embodiment 6 and in a conventional fixing device.

FIG. 12 shows the fixation temperature during the printing operation in the present embodiment, in which a solid line indicates a case of thick paper (155 g/m$^2$) and a broken line indicates a case of ordinary paper (64 g/m$^2$). The present embodiment employs the heater of a somewhat larger rated power than in the foregoing embodiments, so that the temperature remains constant during the printing of 1 to 2 sheets, but the temperature of the fixing device (indicated by the thermistor at the rear face of the heater) decreases in the interval between the papers because the heater 11 is turned off in such interval. The amount of temperature decrease is 10 to 15° C. in the ordinary paper, but is as large as about 30° C. in case of the thick paper, since a larger amount of heat is taken away by the thick paper and the heat transmission to the pressure roller 20 is reduced.

In the present embodiment, therefore, the temperature decrease in the interval between the papers is detected, and the throughput is reduced from 12 sheet/minute to 10 sheet/minute in case of the thick paper showing the large temperature decrease. In this manner the satisfactory fixing performance can be maintained.

In the present embodiment, the heater 11 can maintain a constant temperature, but, as a larger amount of heat is taken away in case of thick papers, the temperature of the pressure roller, normally about 70° C., is lowered to about 50° C.

Stated differently, if the temperature of the pressure roller is low, the fixing performance may be deteriorated even if the heater is maintained at a constant temperature. It is therefore effective for securing the fixing performance, to maintain the constant temperature in the pressure roller by lowering the throughput.

Other Modifications

In the fixing device provided in the image forming apparatus of the present invention, the heating method is not limited to the ceramic heater employed in the foregoing embodiments, but there may also be employed other heating methods.

For example there may be employed an electromagnetic heating method in which a magnetic coil and a conductive member are provided as the heater, and the magnetic power of the coil is applied on the conductive member to generate heat therein by an induction current (for example heat generation by an eddy current loss).

Figure 13A:
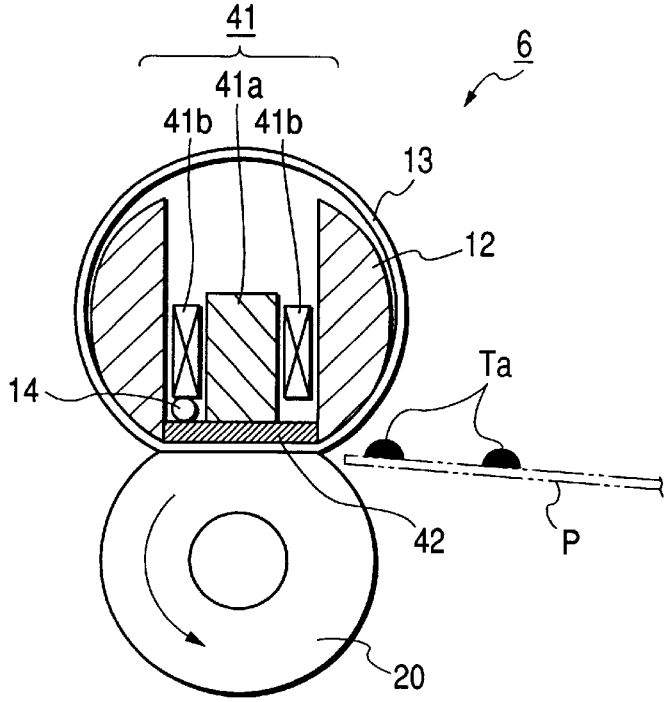
FIGS. 13A, 13B and 13C are schematic views showing the configuration of a fixing device of electromagnetic heating method.

FIG. 13A is a schematic view showing the configuration of a heating device 6 of such electromagnetic heating method.

In FIG. 13A, a stay holder 12 of a trough-shaped cross section is composed, for example, of liquid crystal polymer or phenolic resin, and contains therein a magnetic coil 41 formed by winding a wire 41*b* around a core (iron core) 41*a*.

A plate-shaped conductive member (ferromagnetic metal) 42 is positioned under the stay holder 12. The conductive member 42, the magnetic coil 41 etc. constitute a heater of the electromagnetic heating method.

The fixing film 13 is loosely fitted around the heater assembly consisting of the stay 12, the conductive member 42 and the magnetic coil 41, and the pressure roller 20 is pressed thereto across the fixing film 13.

When the fixing device 6 is turned on by the controller 31, the fixing film 13 is rotated by the pressure roller 20, and an unrepresented excitation circuit applies a voltage to the magnetic coil 41 to generate heat in the conductive member 42 by electromagnetic induction. When the recording material P bearing thereon the unfixed image t is inserted into the fixing nip portion N, the recording material P is passed through the nip portion N together with the fixing film 13 in a state in close contact therewith, whereby the heat from the conductive member 42 is given to the recording material P and the unfixed image t thereon is fixed thereto.

Figure 13B:
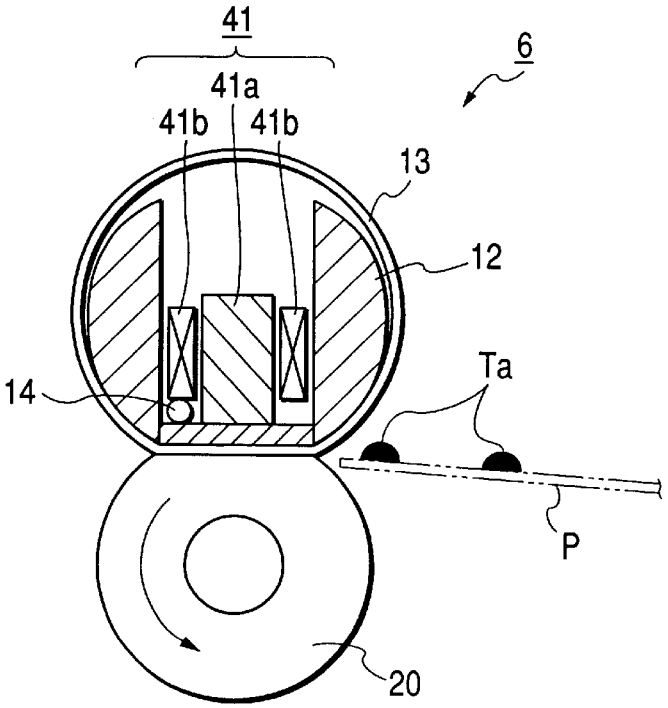

The fixing device 6 of the electromagnetic heating method may also assume a configuration shown in FIG. 13B, in which the conductive member constituting the heater is provided on the fixing film 13 and heat is generated by applying the magnetic force from the coil 41 to the fixing film 13, whereby the heat is given from the film 13 to the recording material P inserted into the nip portion N for achieving image fixation.

Figure 13C:
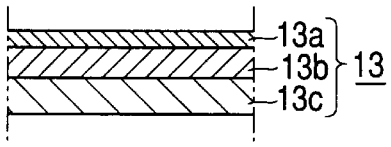
Figure 14:
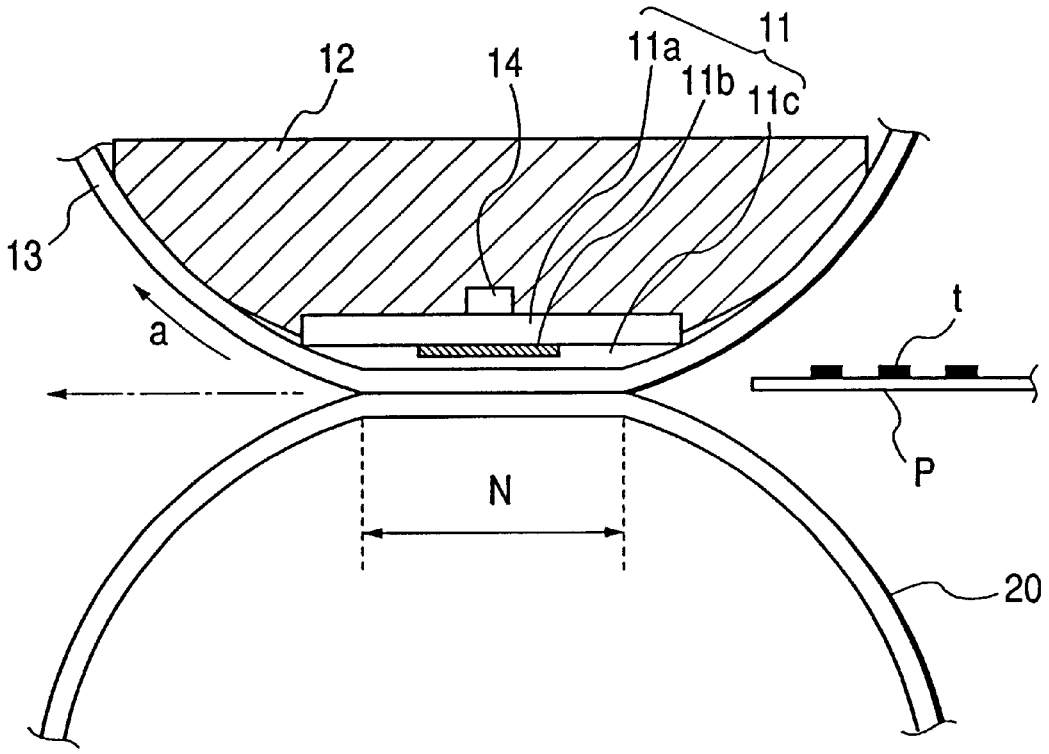
FIG. 14 PRIOR ART
FIG. 14 is a schematic view of a conventional fixing device.

The fixing film 13 has a three-layered structure as shown in FIG. 13C, consisting of an endless film-shaped substrate 13*a* composed of heat-resistant resin such as polyimide, polyamidimide, PEEK, PES, PTFE or FEP, a conductive layer (conductive member) 13*b* formed on the outer periphery of the substrate 13*a* and composed of a metal layer such as of iron, cobalt, nickel, copper or chromium, and a releasing layer 13*c* formed on the outer periphery of the conductive layer 13*b* and composed of heat-resistant resin of satisfactory toner releasing property such as PTF, PTFE or FEP singly or in a mixture. In this example, the film substrate 13*a* and the conductive layer 13*b* are formed as separate layers, but the film substrate itself may be employed as the conductive layer.

The present invention is not limited to the foregoing embodiments but also encompasses any and all modifications of the same technical concept.

What is claimed is:

1. An image forming apparatus, comprising:

image forming means for forming an image on a recording material; and image heating means for heating the image on the recording material by nipping and conveying the recording material, said image heating means including a heater which does not generate heat during a standby period in which a printing operation can be started;

wherein said heater is controlled at a predetermined temperature for a predetermined period after a start of power supply to said apparatus, and then said apparatus is rendered capable of the printing operation.

2. An image forming apparatus according to claim 1, wherein said fixing means includes:

a film movable with an unfixed image on the recording material while being in contact with said heater; and a pressing roller for forming a nip in cooperation with said heater, with said film being interposed.

3. An image forming apparatus according to claim 2, wherein said film and said pressing roller are rotated while said heater is controlled for the predetermined period.

* * * * *

UNITED STATES PATENT AND TRADEMARK OFFICE

CERTIFICATE OF CORRECTION

PATENT NO. : 6,298,213 B1
DATED : October 2, 2001
INVENTOR(S) : Toshio Miyamoto et al.

It is certified that error appears in the above-identified patent and that said Letters Patent is hereby corrected as shown below:

Column 3,
Line 42, "transferred;" should read -- transferred, --.

Column 10,
Line 51, "be" (2nd occurrence) should be deleted.

Column 12,
Line 33, "device·6" should read -- device 6 --.

Column 13,
Line 3, "started;" should read -- started, --.

Signed and Sealed this

Fifth Day of March, 2002

*Attest:*

*Attesting Officer*

JAMES E. ROGAN
*Director of the United States Patent and Trademark Office*